US005228523A

United States Patent [19]

Rahm

[11] Patent Number: 5,228,523

[45] Date of Patent: Jul. 20, 1993

[54] PNEUMATIC POWER TOOL

[75] Inventor: Erik R. Rahm, Väsby, Sweden

[73] Assignee: Atlas Copco Tools AB, Stockholm, Sweden

[21] Appl. No.: 935,136

[22] Filed: Aug. 24, 1992

Related U.S. Application Data

[63] Continuation-in-part of Ser. No. 777,805, Oct. 17, 1991, abandoned.

[30] Foreign Application Priority Data

Oct. 19, 1990 [SE] Sweden ..... 9003356

[51] Int. Cl.[5] ..... B25D 17/12

[52] U.S. Cl. ..... 173/219; 173/169; 173/DIG. 2

[58] Field of Search ..... 173/169, 168, 170, 178, 173/179, 180, DIG. 2, 219

[56] References Cited

U.S. PATENT DOCUMENTS

| | | | |
|---|---|---|---|
| 2,261,204 | 11/1941 | Amtsberg | 173/168 X |
| 2,801,415 | 8/1957 | Jenny | 173/169 X |
| 2,818,570 | 1/1958 | Faccou | 173/169 |
| 2,918,675 | 12/1959 | Smith | 173/169 X |
| 3,334,695 | 8/1967 | Rosenberger et al. | 173/169 |
| 4,109,735 | 8/1978 | Bent | 173/169 |
| 4,298,074 | 11/1981 | Mattchen | 173/137 X |

FOREIGN PATENT DOCUMENTS 1442469 7/1976 United Kingdom .

*Primary Examiner*—Douglas D. Watts
*Assistant Examiner*—Rinaldi Rada
*Attorney, Agent, or Firm*—Frishauf, Holtz, Goodman & Woodward

[57] ABSTRACT

A pneumatic power tool includes a housing (10), a motor (14), an air inlet passage (23) in the housing (10) communicating with the motor (14), a pistol type handle (12) extending from the housing (10) perpendicularly to the application direction of the tool, and an air communication arrangement (16, 20, 23) for connecting the air inlet passage (23) to a pressure air supply conduit connected to the tool, wherein the air communication arrangement (16, 20, 23) is separated from the handle (12) and comprises an air supply passage forming member (16) connected to the rear part of the housing (10), and an exhaust air passage (25, 26) having an outlet portion (26) coaxially disposed relative to the air supply passage forming member (16).

7 Claims, 2 Drawing Sheets

PNEUMATIC POWER TOOL

This application is a continuation-in-part, of application Ser. No. 07/777,805 filed Oct. 17, 1991, now abandoned.

BACKGROUND OF THE INVENTION

This invention relates to a pneumatic power tool, in particular a pneumatic power tool comprising a housing, a motor, an air inlet passage in the housing communicating with the motor, a pistol type handle extending from the housing substantially perpendicularly to the application direction of the tool, and an air communication means for connecting the air inlet passage to a pressure air supply conduit connected to the tool.

In practically all prior art pneumatic power tools of the above type, the air communication means, i.e. inlet and exhaust passages, are located in the handle. This means that the pressure air supply hose as well as the exhaust air ducting hose, when used, are connected to the lower end of the handle. In working areas where the tool is used in horizontal application directions, which is the most common application for pistol handle tools, and the pressure air hose extends from a hose reel located above the working area of the tool, the air hose connected to the lower end of the handle causes an awkward handling of the tool.

Prior attempts to solve this problem have comprised the employment of a U-shaped pipe between the tool handle and the air hose, thereby obtaining a closer bend of the line in that the hose itself is not bent. However, the handling of the tool is not really improved since the hose still runs in parallel with the handle.

Another problem concerned with pistol handle type pneumatic tools having the exhaust passage located in the handle is the undesirable cooling of the handle. This is the case, for example when ducting away of the exhaust air is desired via a hose connected coaxially with the pressure air supply hose.

SUMMARY OF THE INVENTION

According to the present invention, a pneumatic power tool for applying power to a workpiece in an application direction comprises a housing; a motor; an air inlet passage in the housing and communicating with the motor; a pistol type handle extending from the housing substantially perpendicularly to the application direction of the tool; and an air communication means for connecting the air inlet passage to an external pressure air supply conduit. The air communication means is separated from the handle, and comprises an air supply conduit connecting member rigidly mounted on and extending from the housing substantially perpendicularly to the application direction of the tool and located substantially opposite to the handle; and an exhaust air outlet means disposed in a coaxial relationship with the air supply conduit connecting member for exhausting air from the power tool.

An embodiment of the invention is described below in detail with reference to the accompanying drawings.

DETAILED DESCRIPTION

Figure 1:
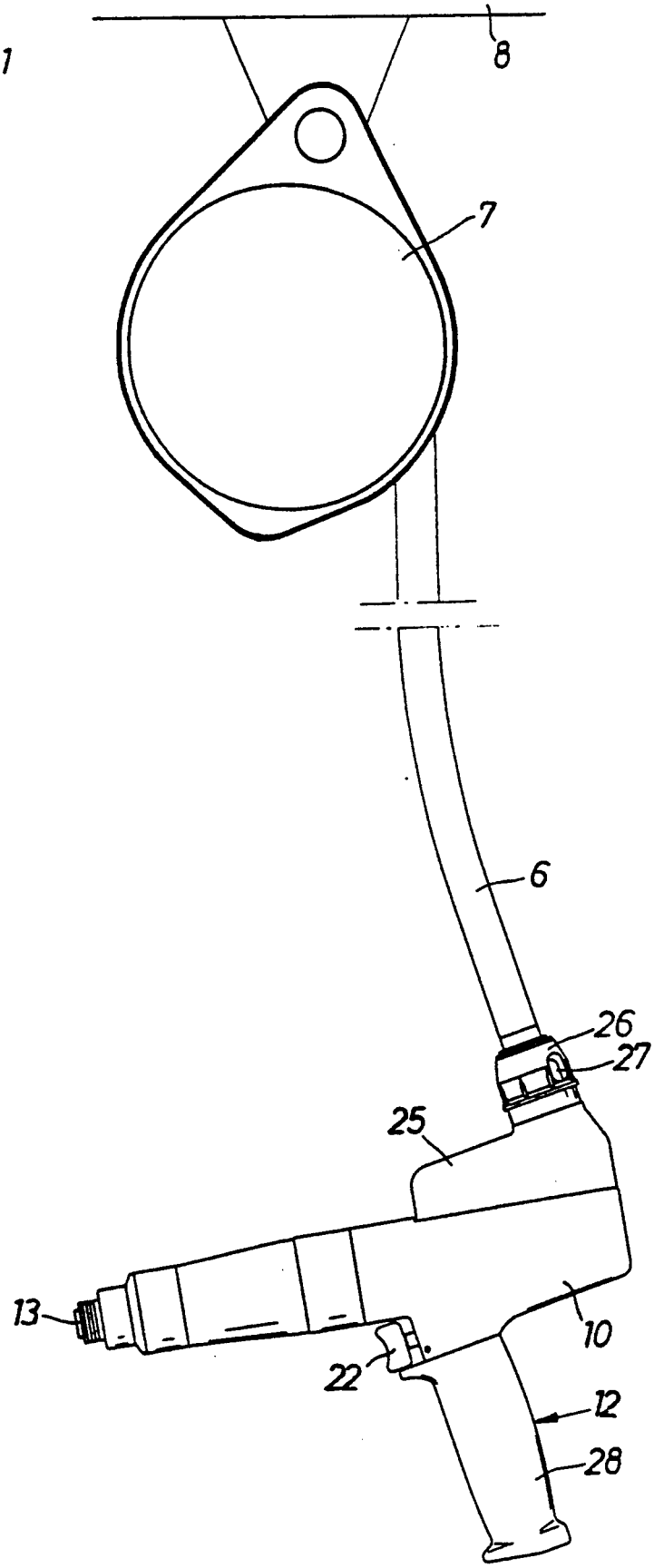
FIG. 1 shows a pneumatic power tool according to the invention suspended by the pressure air hose in a weight balancing hose reel.
Figure 2:
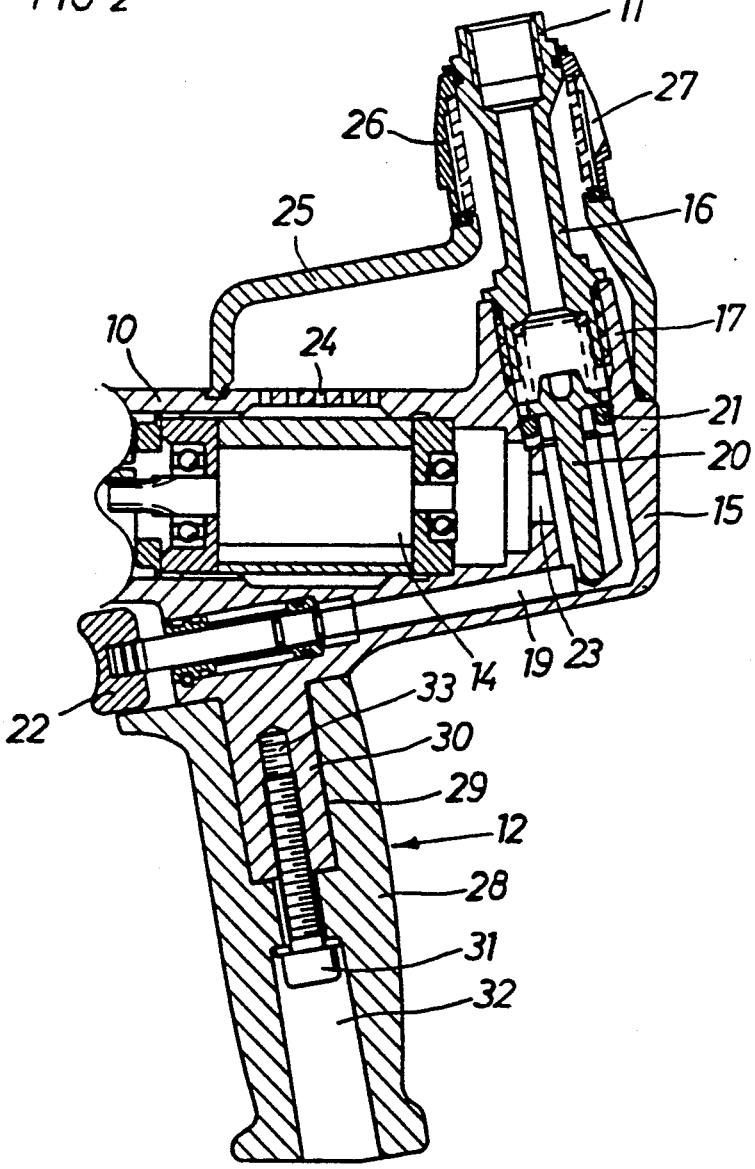
FIG. 2 shows a longitudinal section through the rear part of power tool in FIG. 1.

The tool shown on the drawings is a pneumatically powered screw tightening tool which is suspended in its working position by a pressure air supply hose 6 connected to the tool. The hose 6 is wound on a weight balancing hose reel 7, which is mounted on a firm overhead building structure like a beam 8.

The power tool shown in the drawing figures comprises a housing 10, a pressure air supply hose connection 11, a pistol type handle 12 and an output shaft 13 extending out of the front part of the housing 10. The output shaft 13 is coupled to a pneumatic vane motor 14 via a mechanical power transmission (not shown).

The connection 11 for the pressure air supply hose 6 is located at the upper end of an air inlet pipe 16 which is threaded into a socket portion 17 in the rear end portion 15 of the housing 10. This socket portion 17 has a direction substantially opposite the handle 12 and perpendicular to the application direction of the tool, which is in the axial direction of the output shaft 13. This means that when the tool is used with the handle 12 directed downwards, which is normally the case, the inlet pipe 16 is directed upwards.

In the rear end portion 15 of the housing 10, there is mounted a tilting type throttle valve 20 sealingly cooperating with a seat 21. The valve 20 is operated by a common pistol type trigger 22 on the handle 12. The trigger 22 is provided with an extension rod 19 to reach the stem of the valve 20.

Downstream of the throttle valve 20, an air feed passage 23 leads pressure air from the valve 20 to the motor 14. The exhaust air from the motor 14 is vented from the housing 10 through a number of openings 24 into an outlet casing 25. The latter is mounted on top of the tool housing 10 and surrounds the air inlet pipe 16. At its upper end, the outlet casing 25 is provided with a rotatable outlet sleeve 26 which surrounds the inlet pipe 16 in a coaxial relationship and which comprises one or more openings 27 for directing the exhaust air flow as desired.

The outlet openings 24 have a total area adapted to form a flow restriction for the exhaust air leaving the housing 10 during normal operation of the tool, and the outlet casing 25 defines an expansion volume which in combination with the flow restricting outlet openings 24 forms an efficient exhaust muffler. The actual number of outlet openings 24 is not critical for the operation of the muffler, although several small openings provide for more efficient muffler operation than a single larger opening. Accordingly, the number of outlet openings 24 could be one or more.

Since the outlet casing 25 and sleeve 26 surround the inlet pipe 16 in a coaxial relationship, a hose for ducting away the exhaust air from the tool may be attached coaxially with the pressure air supply hose. Such an exhaust hose is connected directly on the outlet sleeve 26.

The pistol type handle 12 comprises a grip element 28 which is formed with a socket portion 29 of square cross section for fitting on a projection 30 of a corresponding cross section on the housing 10. The grip element 28 is secured to the housing 10 by a screw 31 which is inserted through a stepped bore 32 in the grip element 28 and which engages a threaded bore 33 in the square projection 30.

As being apparent from FIG. 1, the air communication means in the form of the upwardly directed inlet pipe 16 and the exhaust casing 25 provides for a more comfortable handling of the tool, since the upwardly running pressure air supply hose 6 does not interfere with the grip area around the handle 12. It is also clearly illustrated that the air hose 6 very well may be used for suspending the tool in a balancing device. Thereby, the commonly used suspension yoke on the tool and the suspension cable coupling the tool to a balancing reel may be omitted.

It is important to note, however, that the invention is not limited to the specific inlet pipe location illustrated in the described example. The invention relates to a handle separated tool housing mounted air communication means with coaxial air supply and air exhaust passages, and the very location of these means may be varied within the scope of the claims in order to adapt the tool to various working conditions. For instance, the air communication means may be located at the rear end wall of the housing 10 to facilitate operation of the tool in a downward direction.

I claim:

1. A pneumatic power tool for applying power to a workpiece in an application direction, comprising:

a housing (10);

a motor (14);

an air inlet passage (23) in said housing (10) and communicating with said motor (14);

a pistol type handle (12) extending from said housing (10) substantially perpendicularly to the application direction of the tool; and air communication means (16, 20, 25, 26) for connecting said air inlet passage (23) to an external pressure air supply conduit (6);

said air communication means (16, 20, 25, 26) being spaced from said handle and comprising:

an air supply conduit connecting inlet pipe (16) rigidly mounted on said housing (10) in a location substantially opposite said handle (12) and extending from said housing (10) substantially perpendicularly to the application direction of the tool and substantially parallel to said handle (12); and an exhaust air passage including a muffler which comprises at least one outlet opening (24) in said housing (10) having a total area adapted to restrict the exhaust air flow during normal operation of the tool, an outlet casing (25) mounted on said housing (10) and defining an expansion volume communicating with said at least one outlet opening (24) and an exhaust air outlet means (26) mounted on said outlet casing (25) and communicating with said expansion volume;

said exhaust air outlet means (26) being disposed in a coaxial relationship with said air supply conduit connecting inlet pipe (16) for exhausting air from the power tool.

2. The power tool of claim 1, wherein said exhaust air outlet means (26) comprises a coupling member for connection of an exhaust air conduit in a coaxial relationship with said pressure air supply conduit (6).

3. The power tool of claim 2, wherein:

said air communication means (16, 20, 25, 26) comprises a throttle valve (20); and a trigger (22) is located on said handle (12) and is arranged to operate said throttle valve (20) via a coupling element (19).

4. The power tool of claim 1, wherein said exhaust air outlet means (260 is rotatable for adjustability of a flow direction of exhaust air.

5. The power tool of claim 4, wherein:

said air communication means (16, 20, 25, 26) comprises a throttle valve (20); and a trigger (22) is located on said handle (12) and is arranged to operate said throttle valve (20) via a coupling element (19).

6. The power tool of claim 1, wherein:

said air communication means (16, 20, 25, 26) comprises a throttle valve (20); and a trigger (22) is located on said handle (12) and is arranged to operate said throttle valve (20) via a coupling element (19).

7. The power tool of claim 1, wherein:

said exhaust passage includes a plurality of outlet openings (24) in said housing (10).

* * * * *